US007178188B1

(12) United States Patent
Jaakola

(10) Patent No.: US 7,178,188 B1
(45) Date of Patent: Feb. 20, 2007

(54) BATTERY OPERATED SPA VACUUM

(76) Inventor: Richard Jaakola, 2115 Cook Cir., Thousand Oaks, CA (US) 91360

( * ) Notice: Subject to any disclaimer, the term of this patent is extended or adjusted under 35 U.S.C. 154(b) by 350 days.

(21) Appl. No.: 10/932,863

(22) Filed: Sep. 2, 2004

(51) Int. Cl.
*E04H 4/16* (2006.01)

(52) U.S. Cl. ..... 15/1.7; 210/169

(58) Field of Classification Search ..... 15/1.7; 210/169
See application file for complete search history.

(56) References Cited

U.S. PATENT DOCUMENTS 3,225,930 A * 12/1965 Willinger ..... 210/241
3,755,843 A * 9/1973 Goertzen et al. ..... 15/1.7
4,944,101 A * 7/1990 Goble ..... 15/1.7
4,962,559 A * 10/1990 Schuman ..... 15/1.7
5,317,776 A * 6/1994 DeMoura ..... 15/1.7
5,450,646 A * 9/1995 McHugh et al. ..... 15/22.1
2003/0101523 A1* 6/2003 Lepley ..... 15/1.7

FOREIGN PATENT DOCUMENTS

GB 2015331 * 9/1979
JP 63-107714 * 5/1998

* cited by examiner

*Primary Examiner*—Mark Spisich
(74) *Attorney, Agent, or Firm*—Lawrence J. Gibney, Jr.

(57) ABSTRACT

A device, which acts like a vacuum to suck unwanted particles out of the water in a swimming pool or spa. The device uses a battery and motor which are located in the handle of the device and are not inserted into the water. The motor drives a propeller, which draws water and particles into the device. The particles are sucked into the device and trapped.

5 Claims, 2 Drawing Sheets

BATTERY OPERATED SPA VACUUM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A swimming pool or spa can be a difficult thing to maintain. Often they are kept outside. Thus, debris and unwanted materials are free to enter the water. While chemicals may be added to remove microorganisms, larger materials can only be removed physically. A vacuum adapter to be used when immersed in water is an ideal tool for this task. Because water conducts electricity, a battery operated machine with a motor which stays out of the water would prove beneficial.

A. Field of the Invention

The present invention relates to removing unwanted debris from the floor of a pool or spa.

B. Prior Art

Prior art exists which performs the above described function. Schuman (U.S. Pat. No. 4,962,559), Leginus (U.S. Pat. No. 4,935,980), and DeMoura (U.S. Pat. No. 5,317,776) all provide vacuum devices which aid in cleaning the floor of a pool. However there is nothing in the prior art, which is both battery powered and has the motor near the handle, so as to keep it out of the water. The present invention fulfills these purposes.

BRIEF SUMMARY OF THE INVENTION

The present invention is a vacuum to be used for cleaning swimming pools and spas. The present invention is cordless because it is powered by a battery. The battery and motor will both be enclosed in the body of the handle at the top of the invention. The handle will remain out of the water when in use. The motor will drive a long shaft, which will turn a set of propeller blades. The propeller blades are located behind a guard and will be inserted into the water. The motion of the propeller blades will cause a suction force and draw materials toward the guard in front of the fan blades. A bag, which is located in the casing captures the solid material while letting water pass through the bag. For the owners of a spa or swimming pool, the portability and safety of the present invention are desirable.

DETAILED DESCRIPTION OF THE EMBODIMENTS

Figure 1:
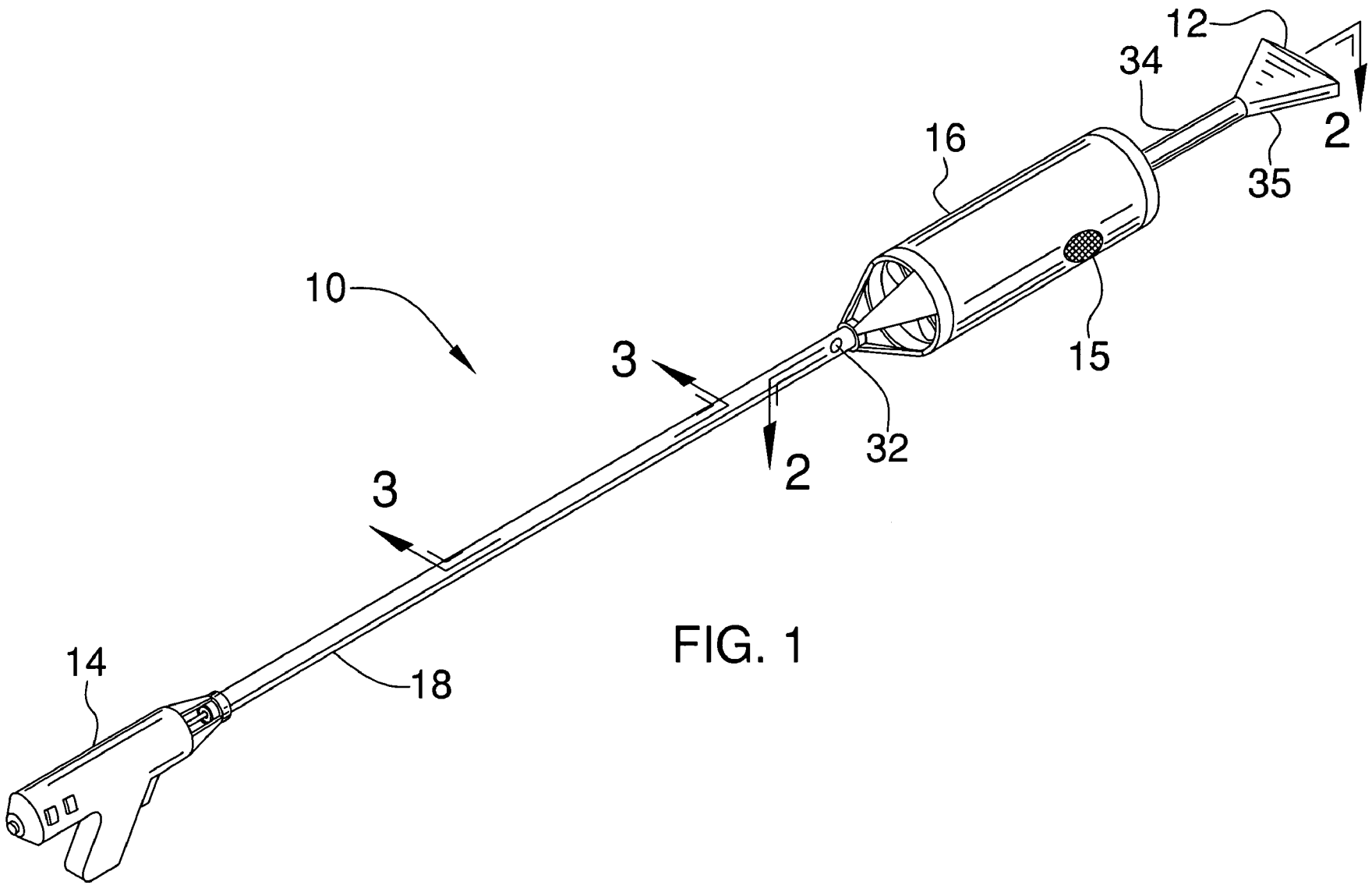
FIG. 1 is a perspective view of the device.

The present invention is a device 10, which acts like a vacuum and can be used to clean the floor of a swimming pool or spa. The shape of the present invention is basically long and thin. The handle 14 is located at one end of the invention and an opening 12 to collect the debris is located on the opposite end. FIG. 1 Various attachment pieces may be attached to the suction end 12 to achieve its stated purpose.

The handle 14 has a grip feature so the user can comfortably hold it. Within the handle structure is a battery and a motor. There is a button on the grip feature, which acts like a trigger to engage the motor.

Figure 3:
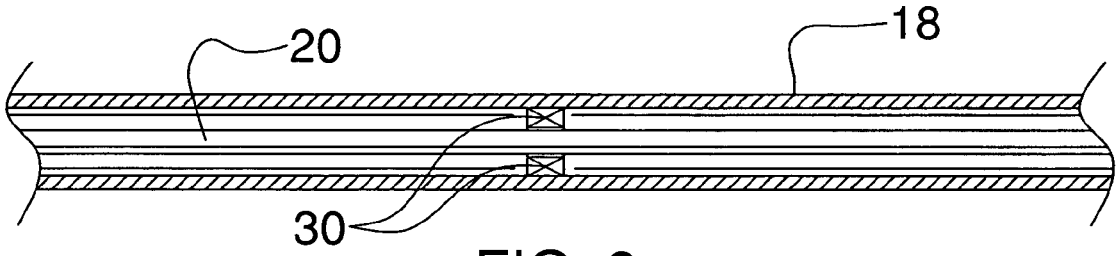
FIG. 3 is a cross sectional view along line 3—3 in FIG. 1.

The user applies pressure to the button when use is desired. A power switch is located on the exterior of the handle 14 and allows the user to easily turn the device 10 on and off. A propeller (abbreviated to "prop" in the remainder of the application) shaft 20 is connected to the motor and exits out of an opening in the front of the handle 14. The prop shaft is a long and thin cylindrical structure and contained within a hollow cylindrical tube 18 protect the prop shaft 20. FIG. 3 The hollow cylindrical tube 18 and prop shaft 20 extend from the handle and connect to a protective casing unit 16. FIG. 1 Support bearings 30 are installed in the hollow cylindrical tube 18 to prevent the shaft from wobbling during normal operation. FIG. 3 A drain hole 32 on the side of the end of the cylindrical tube allows water to drain from the tube as it is lifted out of the water. FIG. 1

Figure 2:
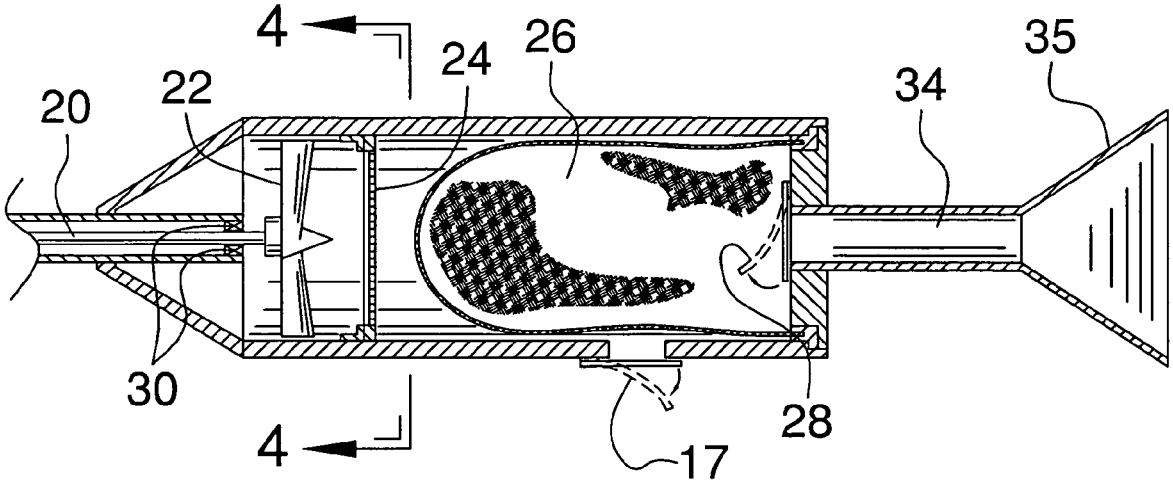
FIG. 2 is a cross sectional view along line 2—2 on FIG. 1.

The shaft extends through the tube 18 and a propeller 22 is attached to one end of the shaft 20. The shaft 20 is connected to a casing unit 16. FIGS. 1, 2

The casing unit 16 is a large cylindrical shaped case which is hollow, open ended on one end and closed on the other end. FIG. 2 Within the protective casing unit 16 is the prop 22. The prop 22 is connected to the prop shaft 20. When the motor is activated, the prop shaft is rotated and causes the prop to rotate inside the casing unit. The motion of the prop creates a vacuum and causes water and objects to be pulled towards it. Within the casing 16 is a flexible collection bag 26 for collection of the debris; this flexible collection bag 26 is connected to the second end of the casing and is positioned such that the bag will be stretched and expand as the device 10 is operated. FIG. 2

Figure 4:
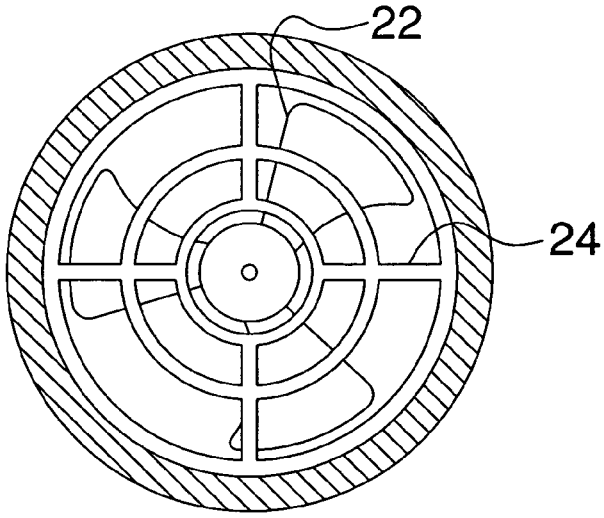
FIG. 4 is a cross sectional view along line 4—4 in FIG. 2.

A prop guard 24 is fixed in front of the prop inside the casing unit 16 between the prop blades 22 and the bag 26. This guard 24 prevents the bag 26 inside the casing 16 from contacting the blades of the prop 22. FIGS. 2, 4

A flexible bag-like structure 26 is attached to the closed or second end of the casing unit 16. It allows water to move through it, but traps any solid materials within the bag. On the side of the casing unit 16 there is a small side flap 17, which acts like a single directional check valve and allows water out when the device is idle. A screen 15 may also cover this flap to add another measure of safety to prevent any debris from entering the casing and damaging the prop 22. FIG. 1 This small side flap 17 is used to help empty water from the casing 16 as the vacuum 10 is removed from the pool or spa. When the unit is on, the suction, which is created by the device 10, will force this flap 17 closed.

On the second end of the casing unit 16, the vacuum attachment 35 located at the suction end 12 to collect the debris, is attached to the casing unit 16 over a hole in the protective casing unit. FIGS. 1, 2 It is contemplated that the vacuum attachment 35 will be constructed similar to the representation in FIG. 1 but other shapes and sizes may be manufactured depending on a particular need. The size or shape of the vacuum attachment 35 is not being claimed as part of this application. The vacuum attachment 35 is connected to the casing unit 16 via a hollow shaft 34 and allows clear communication of the flow of water through the device with the bag in the casing 16 via the opening in the protective casing when the unit is operated. A single directional check valve or flap 28 is positioned over the opening in the protective casing between the attachment point for the vacuum attachment 35 and the bag. A small shaft or tube 34 connects the closed end of the casing 16 and the suction attachments 35. FIGS. 1, 2 In normal operation the flap 28 pens as a vacuum is created by the prop and closes when the device 10 is not operational.

This flap 28 operates as a single direction check valve. As the device is operated and a vacuum is created water and particles are sucked or pulled from the suction end 12 and towards the bag 26. The water will enter the bag through the mouth of the flap 28. Particles, which enter through the suction end 12 by way of the vacuum attachment 35 and pass through the flap 28, will be caught in the flexible collection bag 26 within the casing unit 16. The second end of the casing unit 16 can be removed to clean the flexible collection bag 26 and reattached to the casing unit.

The user can then remove the device 10 from the water and empty the trapped particles into the garbage. Because the battery and motor are usually out of the water, the user does not risk being injured.

The invention claimed is:

1. A device for cleaning a pool or spa comprising:

a. a handle;

said handle has a first end and a second end;

wherein a gripping structure is provided on the first end;

a power switch is incorporated into said handle; and a trigger mechanism is provided on said gripping structure;

b. a power source;

said power source is further comprised of a battery and a motor;

wherein the battery and motor are connected electrically and housed within the handle and operated by the trigger mechanism;

c. a long, hollow cylindrical tube;

said cylindrical tube is further comprised of a first end and a second end of predetermined length;

wherein said tube is cylindrical in shape;

wherein said tube is fixedly attached to said motor at the first end;

wherein the tube secures a propeller at the second end;

wherein a propeller shaft is encased within the long cylindrical hollow tube;

wherein support bearings are contained within the tube;

wherein a hole is provided near the second end to drain water when lifting the device from the water;

d. a protective outer casing;

said protective outer casing has a first and second end and houses a flexible collection bag;

wherein the first end is connected to the long, hollow cylindrical tube;

wherein the second end secures a suction attachment device using a shaft of predetermined length and a hole of predetermined diameter;

wherein a unidirectional valve is positioned over the hole of predetermined diameter at the connection point for the shaft which is connected to the suction attachment device;

wherein the flexible collection bag is connected to the opening for the suction attachment device and fits over a unidirectional valve;

wherein a unidirectional valve is inserted on the side of the protective casing to drain the device when it is pulled from the water;

wherein a guard is installed to prevent the flexible collection bag from striking the propeller during normal operation;

wherein all parts are attached to each other.

2. The device as described in claim 1 wherein the propeller is secured to the propeller shaft and is allowed to freely rotate when the device is in operation.

3. The device as described in claim 1 wherein the flexible collection bag is of a predetermined porosity.

4. The device as described in claim 1 wherein the protective casing is essentially cylindrical in shape.

5. A method for using the device described in claim 1 comprising:

a. gripping the handle securely;

inserting the suction attachment device into the water;

inserting the protective outer casing and propeller into the water;

aiming the suction attachment device at a desired particle to be removed;

switching the power switch to the "on" state;

applying pressure to the trigger mechanism on the handle;

removing the device from the water.

* * * * *